US011618598B2

(12) United States Patent
Domenichini

(10) Patent No.: US 11,618,598 B2
(45) Date of Patent: Apr. 4, 2023

(54) APPARATUS FOR MAKING A MULTIPLICITY OF PACKAGES

(71) Applicant: OCME S.R.L., Parma (IT)

(72) Inventor: Giovanni Domenichini, Basilicagoiano Montechiarugolo (IT)

(73) Assignee: OCME S.R.L., Parma (IT)

( * ) Notice: Subject to any disclaimer, the term of this patent is extended or adjusted under 35 U.S.C. 154(b) by 0 days.

(21) Appl. No.: 17/330,645

(22) Filed: May 26, 2021

(65) Prior Publication Data

US 2021/0371135 A1 Dec. 2, 2021

(30) Foreign Application Priority Data

May 29, 2020 (IT) ..... 102020000012826

(51) Int. Cl.
*B65B 65/00* (2006.01)
*B65B 5/02* (2006.01)
*B65B 61/06* (2006.01)

(52) U.S. Cl.
CPC ..... *B65B 5/026* (2013.01); *B65B 5/028* (2013.01); *B65B 61/06* (2013.01); *B65B 65/003* (2013.01); *B65B 2220/02* (2013.01); *B65B 2220/06* (2013.01)

(58) Field of Classification Search
CPC ..... B65B 5/026; B65B 5/028; B65B 65/006; B65B 65/003; B65B 43/126; B65B 61/08; B65B 61/06; B65B 11/004; B65B 2220/06; B65B 2220/02; B26D 1/245
See application file for complete search history.

(56) References Cited

U.S. PATENT DOCUMENTS 4,617,780 A 10/1986 Focke et al.
4,642,967 A 2/1987 Culpepper
5,765,336 A * 6/1998 Neagle ..... B65B 35/50 53/201
6,006,501 A * 12/1999 Davis ..... B65B 41/16 53/551

(Continued)

FOREIGN PATENT DOCUMENTS

DE 10 2011 106 352 A1 1/2013

OTHER PUBLICATIONS

Italian Search Report dated Feb. 5, 2021 in Italian Application 10202000012826 filed on May 29, 2020, citing documents AA-AC & AO therein, 3 pages (with English Translation of Categories of Cited Documents).

*Primary Examiner* — Thomas M Wittenschlaeger
(74) *Attorney, Agent, or Firm* — Oblon, McClelland, Maier & Neustadt, L.L.P.

(57) ABSTRACT

An apparatus for making a multiplicity of packages including a feeding station, a separation station which is arranged downstream of the feeding station, a single feeding track which carries at least one multiplicity of multiple sheets from the feeding station to the separation station, at least two exit tracks which are arranged downstream of the separation station. Each multiple sheet of the multiplicity of multiple sheets includes at least two portions of sheet lying on a same geometric plane. Each portion of sheet is a single sheet of the package in a flat configuration. Each package of the multiplicity of packages includes at least one product and the single sheet of the package adapted to pass from a flat configuration to a configuration coupled with the at least one product.

11 Claims, 2 Drawing Sheets

(56) References Cited

U.S. PATENT DOCUMENTS

| | | | | |
|---|---|---|---|---|
| 6,233,903 | B1 * | 5/2001 | Ide | B65B 61/08 53/551 |
| 2006/0186592 | A1 * | 8/2006 | Stemmle | B43M 5/04 270/58.07 |
| 2021/0380287 | A1 * | 12/2021 | Candida | B65B 41/06 |

* cited by examiner

APPARATUS FOR MAKING A MULTIPLICITY OF PACKAGES

BACKGROUND OF THE INVENTION

The present invention relates to an apparatus for making a multiplicity of packages.

In the state of the art, apparatuses for making a multiplicity of packages are known, in which each package comprises at least one product and at least one cardboard support for said at least one product.

The cardboard supports are cut from a multiple sheet by means of another cutting machine which is external to the apparatus for making the multiplicity of packages. The cutting machine comprises a cutting press which cuts multiple sheets of 5 or 6 meters per side into a multiplicity of these sheets, each of which is a cardboard support for a package.

The apparatus comprises a feeding station which is fed with already cut cardboard supports.

The apparatus then transports the cardboard supports already cut to be coupled with products to form the package.

The feeding station of the state of the prior art comprises a feeding track which is fed by worker personnel or by machines that load the already cut sheets.

In the state of the prior art, when a person skilled in the art poses the problem of accelerating the production of packages, he is faced with two disadvantageous strategic solutions.

According to a first strategic solution, a feeding track is made faster by increasing the number of already cut sheets that are loaded into the feeding station. Disadvantageously, it is necessary to load more sheets in less time, which means that it is necessary to speed up the feeding track and consequently it is necessary to make the operations for coupling the products with the cardboard supports faster. The speed of these operations disadvantageously has a physical limit due to the fact that coupling the products and the cardboard support requires a period of time that cannot be reduced beyond a certain limit.

According to a second strategic solution, the apparatus is made faster by increasing the number of feeding tracks making them work in parallel to increase the number of already cut sheets that are loaded into the feeding station. Disadvantageously, it is necessary to increase the dimensions of the packaging apparatus by increasing both the feeding tracks and the tracks that couple the products with the cardboard supports. Basically it is like using more than one apparatus that works in parallel on all operations, dispersing at least double the energy necessary to operate a single apparatus with single tracks.

BRIEF SUMMARY OF THE INVENTION

The object of the present invention consists in realising an apparatus for making a multiplicity of packages that overcomes the disadvantages of the prior art, which allows to increase at least twice as much the number of packages produced per unit of time or to reduce by at least half the production times of the packages produced.

In accordance with the invention, this object is achieved with an apparatus for making a multiplicity of packages according to claim 1.

Another object of the present invention consists in realising a process for making a multiplicity of packages that overcomes the disadvantages of the prior art, which allows to increase at least twice as much the number of packages produced per unit of time or to reduce by at least half the production times of the packages produced.

In accordance with the invention, this object is achieved with a process for making a multiplicity of packages according to claim 10.

Other features are envisaged in the dependent claims.

BRIEF DESCRIPTION OF THE DRAWINGS

The features and advantages of the present invention will be more apparent from the following description, which is to be understood as exemplifying and not limiting, with reference to the appended schematic drawings, wherein.

Figure 1:
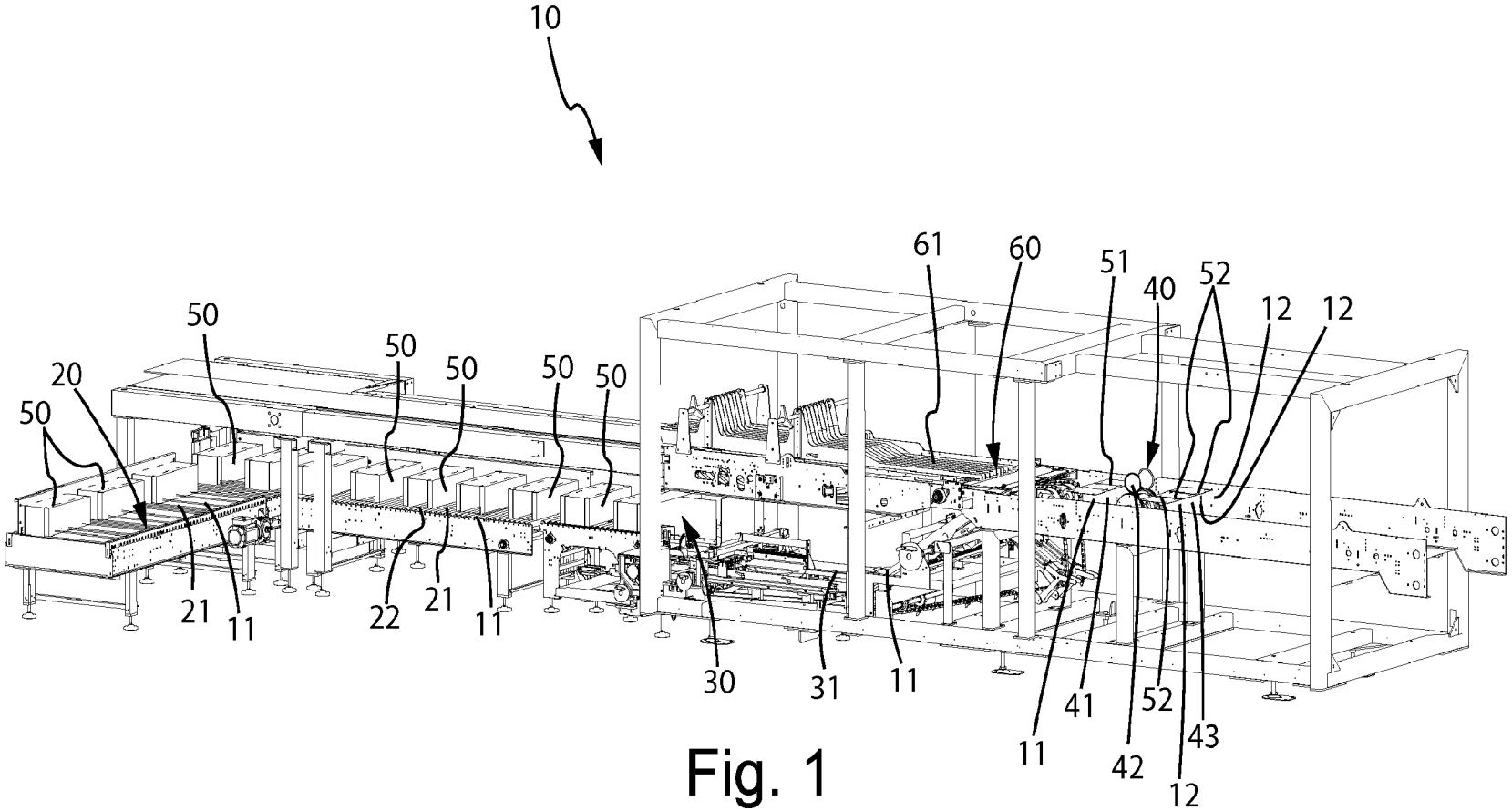
FIG. 1 is a perspective view of an apparatus for making a multiplicity of packages according to the present invention, in which each package comprises at least one cardboard support.

With reference to the aforementioned figures and in particular FIG. 1, an apparatus 10 is shown for making a multiplicity of packages comprising a feeding station 20, a pick-up station 30, a separation station 40 and a folding station, a coupling station 60 which can be positioned alternatively both upstream and downstream of the separation station 40.

Each package of the multiplicity of packages comprises at least one product and one cardboard support for supporting said at least one product. The cardboard support can be a box, a tray or a lower flap to support the products from a lower portion thereof, a lateral flap to support the products from a lateral portion thereof, an upper flap to support the products from an upper portion thereof. The flap is folded and can be folded like a U-board, i.e. with two edges rising from a base. Alternatively, it is envisaged that the folding station may be optional for the cardboard supports that do not require folding.

Each cardboard support of the multiplicity of cardboard supports of the multiplicity of packages consists of a single sheet of the package 52 adapted to pass from a flat configuration to a configuration coupled with said at least one product which forms the cardboard support for said at least one product of the packaging.

When the cardboard support is to be folded to be coupled with the products of the package, then the single sheet of the package 52 in coupled configuration is folded, after being separated, to be coupled with the products of the package.

DETAILED DESCRIPTION OF THE INVENTION

When the cardboard support is not to be folded, the single sheet of the package 52 is directly coupled with the products of the package without being folded.

The apparatus 10 comprises a single feeding track 11 which carries a multiplicity of multiple sheets 51 from the feeding station 20 to the separation station 40.

In the embodiment shown in FIG. 1 it is shown that the feeding track 11 comprises a series of conveyors 21, 31, 41: a loading conveyor 21 of the feeding station 20 which carries a multiplicity of stacks of sheets 50, a first conveyor 31 of the pick-up station 30 which carries a multiplicity of single multiple sheets 51 after they have been picked up from the respective stacks of sheets 50 and a second conveyor 41 of the separation station 40 which carries said multiplicity of single multiple sheets 51 towards the separation device 42 of the separation station 40.

Each stack of sheets 50 consists of a stack of multiple sheets 51 arranged one above the other of the multiplicity of multiple sheets 51.

Figure 2:
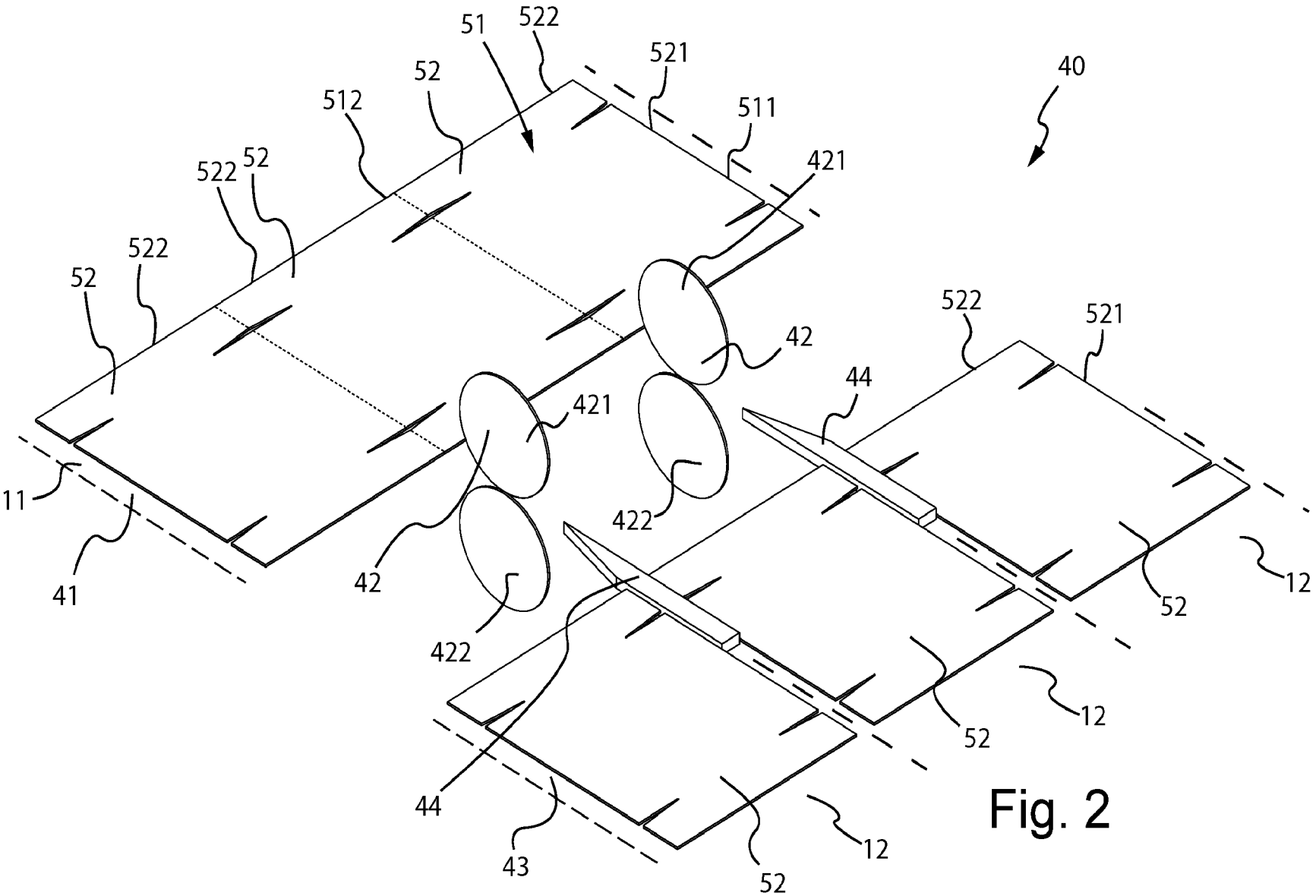
FIG. 2 is a schematic perspective view of a separation station of the apparatus.

In the embodiment shown in FIGS. 1 and 2, each multiple sheet 51 of the multiplicity of multiple sheets 51 consists of three portions of sheet lying on the same geometric plane. Each portion sheet is one of the single sheets of the packages 52 in flat configuration.

As shown in particular in FIG. 2, each multiple sheet 51 is a sheet comprising a first pair of sides 511 that are parallel to each other and a second pair of sides 512 that are parallel to each other. A first side 511 of the first pair of sides 511 of the multiple sheet 51 has dimensions equal to the dimensions of a first side 521 of a first pair of first sides 521 of the single sheet of the package 52. A second side 512 of the second pair of sides 512 of the multiple sheet 51 has dimensions equal to a sum of dimensions of three second sides 522 of a second pair of second sides 522 of the three single sheets of the packages 52 in flat configuration. It is pointed out that each multiple sheet 51 is separated into the three single sheets of the package 52 without waste material.

The multiple sheet 51 is preferably made of double or triple or multiple die-cut cardboard.

The loading conveyor 21 of the feeding station 20 comprises at least one support base 22. The support base 22 is adapted to support said at least one stack of sheets 50, for example the base can comprise rollers or conveyor belts.

The loading conveyor 21 of the feeding track 11 carries a multiplicity of stacks of sheets 50, wherein each stack of sheets 50 is preferably spaced by a predetermined space from another stack of sheets 50 of said multiplicity of stacks of sheets 50, so that a preceding stack 50 is spaced apart by the predefined space from the following stack 50. The predefined space is defined along a longitudinal dimension of the loading conveyor 21, wherein the longitudinal dimension is arranged in the direction of motion of the loading conveyor 21.

The pick-up station 30 is arranged downstream of the feeding station 20 and comprises a pick-up device which picks up a single multiple sheet 51 at a time from the stack of sheets 50, wherein the first conveyor 31 carries said multiplicity of single multiple sheets 51.

The separation station 40 is arranged downstream of the pick-up station 30 and comprises the second conveyor 41 which carries single multiple sheets 51, two separation devices 42 which separate by cutting the single multiple sheet 51 into three single sheets of the packages 52.

Three exit tracks 12 branch off at the exit of the separation device 42 of the separation station 40.

In the embodiment of FIGS. 1 and 2, the separation station 40 comprises a single exit conveyor for the three exit tracks 12, wherein said exit conveyor 43 carries the three single sheets of the packages 52 out of the separation station 40 in flat configuration and separated by cutting.

Each separation device 42 of the separation station 40 comprises cutting elements 421, 422 adapted to cut said single multiple sheet 51 into at least two single sheets of the packages 52 in flat configuration. In this embodiment, the cutting elements 421, 422 are two rotating blades.

Preferably, the separation devices 42 of said separation station 40 are adapted to pass from a fixed configuration to a translatable configuration, wherein said translatable configuration of the separation device 42 provides that the separation devices 42 are free to translate along a transverse direction of said feeding track 11 so that it is possible to advantageously vary the dimensions and format of the multiple sheets 51.

Preferably, as shown in FIG. 2, the exit conveyor 43 comprises two spacing devices 44 which space apart from each other the three single sheets of the packages 52 in flat configuration.

The two spacing devices 44 of the exit conveyor 43 of the separation station 40 are two mobile guides. Each mobile guide is adapted to pass from a fixed configuration to a translatable configuration, wherein said translatable configuration of the mobile guide provides that the mobile guide is free to translate along a transverse direction of the exit conveyor 43. The transverse direction is perpendicular to the longitudinal direction.

Each mobile guide 43 is arranged at the separation device 42 so as to be able to advantageously intercept the single sheet of the package 52 and lead it to the respective exit track 12.

The exit tracks 12 are as many as the single sheets of the package 52 of the single multiple sheet 51.

The exit tracks 12 operate in parallel all the operations necessary to complete the package.

In the embodiment described there is also the folding station which is arranged downstream of the separation station 40 and comprises folding devices which fold each single sheet of the package 52 making it pass from the flat configuration to the folded configuration to form the support for at least the product of the package.

In a first alternative shown in FIG. 1, the coupling station 60 which is adapted to couple at least the product with each single sheet of the package 52, is arranged upstream of the separation station 40. The coupling station 60 comprises an insertion device 61 which couples at least one product with each of the multiple sheets 51 at each of the three single sheets of the packages 52, wherein the three single sheets of the packages 52 are still joined one another to form the single multiple sheet 51.

In a second alternative which is not shown in the figures, the coupling station 60 is arranged downstream of the separation station 40. In this second alternative, the coupling station 60 comprises an insertion device 61 which couples at least the product with each of the single sheets of the separate packages 52.

Advantageously, the apparatus 10 for making a multiplicity of packages according to the present invention overcomes the disadvantages of the prior art, increases the number of packages produced per unit of time by at least the double or reduces the production times of the packages produced by half.

Advantageously, it is not necessary to modify the speed of the feeding track 11, nor of the exit tracks 12.

As far as the operation of the apparatus 10 is concerned, a process is provided for making a multiplicity of packages by means of the apparatus 10.

The process comprises a sequence of operations in chronological order between them.

The process comprises a first operation of loading a multiplicity of multiple sheets 51 onto the single feeding track 11 in the feeding station 20 of the apparatus 10.

The process comprises a second operation of transport of said multiplicity of multiple sheets 51 by means of at least one conveyor 21, 31, 41 of the single feeding track 11 of the feeding station 20 to the separation station 40.

If the multiplicity of multiple sheets 51 is stacked in stacks of sheets 50, then it is provided that the process also comprises an operation of picking up a single multiple sheet 51 at a time from the stack of sheets 50 by means of a pick-up device of the pick-up station 30 of the apparatus 10.

The process comprises a subsequent operation of separation of the single multiple sheet 51 into at least two single sheets of the packages 52 in flat configuration by means of the separation device 42 of the separation station 40. The separation operation can provide for the cutting of the single multiple sheet 51 or the separation of the partially pre-cut multiple sheet 51 into the single sheets of the package 52.

The process comprises a subsequent operation of transport of the at least two single sheets of the packages 52 in flat configuration by means of the at least two exit tracks 12 of the apparatus 10.

The process can comprise a subsequent operation of spacing the at least two single sheets of the packages 52 in flat configuration at a distance from each other by means of the at least one spacing device 44 of the separation station 40.

If it is necessary to fold the single sheets of the package 52, then the process may comprise a subsequent operation of folding each single sheet of the package 52 by making it pass from the flat configuration to the folded configuration so as to form the support for the products of the package by means of the folding station of the apparatus 10.

The process comprises two alternative operations of coupling products with the single sheets of the packages 52. According to the first alternative, the coupling takes place before the separation operation, subsequently providing for a folding after cutting if necessary, and according to the second alternative, the coupling takes place after the separation operation.

Advantageously, the process for making a multiplicity of packages by means of the apparatus 10 overcomes the disadvantages of the prior art, increases the number of packages produced per unit of time by at least the double or reduces the production times of the packages produced by half.

Alternatively, it is possible to provide that each single multiple sheet 51 consists of at least two portions of sheet, wherein each portion of sheet is a single sheet of the package 52.

Alternatively, it is possible to provide that the feeding track 11 comprises a single conveyor between the conveyors 21, 31, or 41.

Alternatively, it is possible to provide that the feeding track 11 comprises a multiplicity of conveyors 21, 31, 41 arranged in sequence with each other so as to form the single feeding track 11, wherein each conveyor 21, 31, 41 carries the multiplicity of multiple sheets 51 from the feeding station 20 to the separation device 42 of the separation station 40 on a single track 11.

Alternatively, it is possible to provide that the feeding track 11 carries a multiplicity of multiple sheets 51 which are not initially arranged in stacks of sheets 50, but stored in a different way, for example they can be stored standing or in any other way already known in the state of the art.

Alternatively, it is not necessary to have a station 30 for picking up a single multiple sheet 51 at a time when there are no stacks of sheets 50.

Alternatively, the multiple sheet 51 is made of paper, or of plastic material, or of other equivalent material so as to be separated or cut by the apparatus 10 according to the present invention.

Alternatively, it is possible to provide that the separation device 42 of the separation station 40 comprises cutting elements 421, 422 adapted to cut the single multiple sheet 51 into said at least two single sheets of the packages 52, wherein the cutting elements 421, 422 can alternatively be a rotating and a fixed cutting blade, or other known cutting technologies which may not even include the use of blades.

Alternatively, it is possible to provide that the separation device 42 of the separation station 40 comprises separation elements such as for example wheels which divide the multiple sheet 51 into the single sheets of the package 52, in which the multiple sheet 51 is already partially pre-cut, so much so that the wheels are sufficient to separate it completely into single sheets of the package 52.

Alternatively, it is possible to provide that the spacing device 44 is not necessary, since it may not always be necessary to have to space apart the different single sheets of the packages 52 transversely.

Alternatively, the separation station 40 comprises as many exit conveyors 43 as there are exit tracks 12.

Alternatively, the apparatus 10 can comprise a multiplicity of stations that carry out a multiplicity of operations that may be different from those described in the first embodiment.

The invention thus conceived is susceptible to many modifications and variants, all falling within the same inventive concept; furthermore, all details can be replaced by equivalent technical elements. In practice, the materials used, as well as the dimensions thereof, can be of any type according to the technical requirements.

The invention claimed is:

1. An apparatus for making a multiplicity of packages comprising a feeding station, a separation station arranged downstream of said feeding station, a single feeding track carrying at least one multiplicity of multiple sheets from said feeding station to said separation station, at least two exit tracks arranged downstream of said separation station, wherein each multiple sheet of said multiplicity of multiple sheets includes at least two portions of sheet lying on a same geometric plane, wherein each portion of sheet is a single sheet in a flat configuration, wherein each package of said multiplicity of packages comprises at least one product and said single sheet, the single sheet being adapted to pass from the flat configuration to a configuration coupled with said at least one product, wherein in said coupled configuration of each single sheet and the at least one product, each single sheet forms a support for said at least one product of the package, wherein said separation station comprises at least one separation device which separates each of at least one multiple sheet into at least two single separate sheets, wherein each exit track of said at least two exit tracks carries at least one single separate sheet of said at least two single separate sheets.

2. The apparatus according to claim 1, further comprising a coupling station which is adapted to couple at least one product with one corresponding single sheet of said multiplicity of single sheets, wherein said coupling station is arranged upstream of the separation station, and wherein said coupling station comprises an insertion device which couples said at least one product with each of single sheets of the packages still joined so as to form said multiple sheets.

3. The apparatus according to claim 1, further comprising a coupling station which is adapted to couple at least one product with one corresponding single sheet of said multiplicity of single sheets of the packages, wherein said coupling station is arranged downstream of the separation station, and wherein said coupling station comprises an insertion device which couples said at least one product with each of said single separate sheets of the packages.

4. The apparatus according to claim 1, wherein said at least one separation device of said separation station comprises cutting elements adapted to cut said single multiple sheet into said at least two single sheets of the packages in the flat configuration.

5. The apparatus according to claim 1, wherein said at least one separation device of said separation station comprises separation elements adapted to divide said single multiple sheet into said at least two single sheets of the packages in the flat configuration.

6. The apparatus according to claim 1, wherein said at least one separation device of said separation station is adapted to pass from a fixed configuration to a translatable configuration, wherein in the translatable configuration the separation device is configured to translate along a transverse direction of said feeding track.

7. The apparatus according to claim 1, wherein said separation station comprises at least one spacing device which spaces apart from each other said at least two single separate sheets of the packages in the flat configuration.

8. The apparatus according to claim 7, wherein said at least one spacing device of said separation station is a mobile guide, wherein said mobile guide is adapted to pass from a fixed configuration to a translatable configuration, and wherein in the translatable configuration the mobile guide is configured to translate along a transverse direction of said at least two exit tracks.

9. The apparatus according to claim 1, wherein said multiple sheet is made of die-cut cardboard.

10. A process for making a multiplicity of packages with an apparatus according to claim 1, wherein each multiple sheet of said multiplicity of multiple sheets includes at least two portions of sheet lying on a same geometric plane, wherein each portion of sheet is a single sheet in a flat configuration, wherein each package of said multiplicity of packages comprises at least one product and said single sheet, the single sheet being adapted to pass from the flat configuration to a configuration coupled with said at least one product, wherein in said coupled configuration of each single sheet and the at least one product, each single sheet forms a support for said at least one product of the package, wherein said process comprises a sequence of operations in chronological order, the sequence of operations including:

an operation for carrying the at least one multiplicity of multiple sheets with the single feeding track from the feeding station to the separation station of said apparatus, an operation for separating said single multiple sheet into at least two single sheets in the flat configuration with a separation device of said separation station, and an operation for carrying each of said at least two single sheets in flat configuration with each of said at least two exit tracks of said apparatus.

11. The process according to claim 10, comprises an operation for spacing apart said at least two single sheets of the packages in the flat configuration at a distance from each other with at least one spacing device of the separation station, wherein said spacing operation takes place following the separation operation.

* * * * *